US010202212B2

(12) United States Patent
Nagata et al.

(10) Patent No.: US 10,202,212 B2
(45) Date of Patent: Feb. 12, 2019

(54) METHOD AND APPARATUS FOR BOXING RECTANGULAR ARTICLES

(71) Applicant: TOYO SEIKAN GROUP HOLDINGS, LTD., Tokyo (JP)

(72) Inventors: Kouji Nagata, Yokohama (JP); Satoru Nemoto, Yokohama (JP); Toshirou Satou, Yokohama (JP)

(73) Assignee: TOYO SEIKAN GROUP HOLDINGS, LTD., Tokyo (JP)

( * ) Notice: Subject to any disclaimer, the term of this patent is extended or adjusted under 35 U.S.C. 154(b) by 586 days.

(21) Appl. No.: 14/935,178

(22) Filed: Nov. 6, 2015

(65) Prior Publication Data

US 2016/0059972 A1 Mar. 3, 2016

Related U.S. Application Data

(63) Continuation of application No. PCT/JP2014/061933, filed on Apr. 30, 2014.

(30) Foreign Application Priority Data

May 8, 2013 (JP) ..... 2013-098196

(51) Int. Cl.
*B65B 5/10* (2006.01)
*B65B 5/06* (2006.01)
(Continued)

(52) U.S. Cl.
CPC ..... *B65B 5/06* (2013.01); *B65B 5/108* (2013.01); *B65B 35/58* (2013.01); *B65B 43/185* (2013.01); *B65B 43/42* (2013.01); *B65B 2220/16* (2013.01)

(58) Field of Classification Search
CPC ..... B65B 5/105
(Continued)

(56) References Cited

U.S. PATENT DOCUMENTS

2003/0136641 A1 7/2003 Iwasa et al.
2005/0229548 A1 10/2005 Hooper
2009/0249750 A1 10/2009 Black et al.

FOREIGN PATENT DOCUMENTS

EP 1 329 384 A1 7/2003
JP 4-339705 A 11/1992
(Continued)

OTHER PUBLICATIONS

Extended (supplementary) European Search Report dated Dec. 6, 2016, issued in counterpart European Application No. 14794008.4. (8 pages).

(Continued)

*Primary Examiner* — Lori Baker
(74) *Attorney, Agent, or Firm* — Westerman, Hattori, Daniels & Adrian, LLP

(57) ABSTRACT

A rectangular article boxing method of the present invention includes: a step of erecting upright and aligning a bundle of rectangular articles, gripping, lifting, transferring, and lowering the bundle and inserting the bundle between a first guide and a second guide disposed at a predetermined interval in a carton; a step of displacing the first guide to above the upright bundle; a step of moving the inserted bundle to a position in contact with the existing bundle and holding the bundles with the second guide; a step of holding the upright bundles with the first guide in place of the second guide; and a step of displacing the second guide to a position at the predetermined interval from the first guide to receive the bundle to be conveyed next.

10 Claims, 4 Drawing Sheets

(51) Int. Cl.

| | |
|---|---|
| ***B65B 35/58*** | (2006.01) |
| ***B65B 43/18*** | (2006.01) |
| ***B65B 43/42*** | (2006.01) |

(58) Field of Classification Search
USPC ..... 53/471, 475; 426/138; 215/47; 206/404
See application file for complete search history.

(56) References Cited

FOREIGN PATENT DOCUMENTS

| | | | |
|---|---|---|---|
| JP | 8-91304 | A | 4/1996 |
| JP | 10-16910 | A | 1/1998 |
| JP | 2005-529809 | A | 10/2005 |
| JP | 2008-302962 | A | 12/2008 |
| WO | 2012/075520 | A1 | 6/2012 |

OTHER PUBLICATIONS

International Search Report dated Jul. 22, 2014, issued in corresponding application No. PCT/JP2014/061933.
Office Action dated Aug. 25, 2017, issued in counterpart European Application No. 14794008.4. (5 pages).

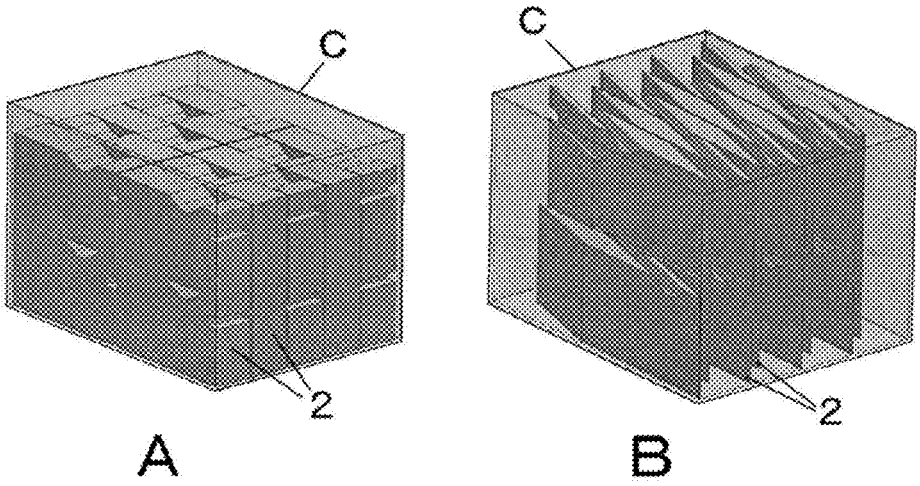
FIG.6
Fig. 7
Prior Art
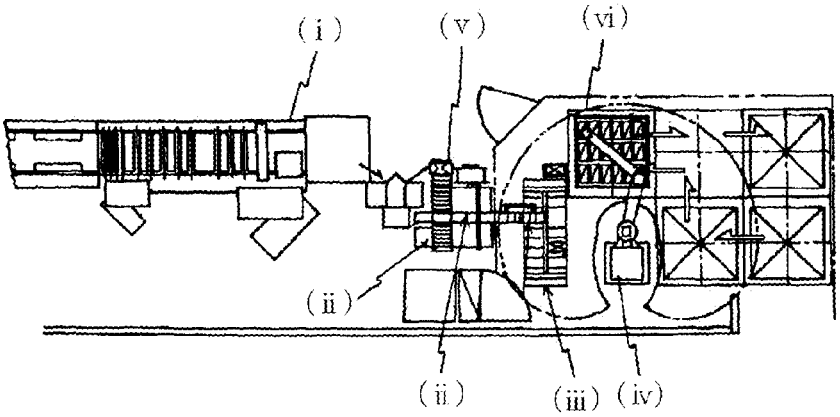

METHOD AND APPARATUS FOR BOXING RECTANGULAR ARTICLES

TECHNICAL FIELD

The present invention relates to a rectangular article boxing method for boxing, in an upright state in a carton, a bound plurality of rectangular articles such as a standing pouch and an apparatus for carrying out the method.

BACKGROUND ART

A rectangular article such as a pouch to be filled with a liquid cleaning agent is boxed and shipped from a pouch manufacturing factory. A plurality of pouches manufactured in a manufacturing line (a pouch manufacturing process) are bound and sequentially packed in a box body. As one of packing forms, there is a form usually called "vertical loading" for inserting pouch bundles of pouches (usually, twenty-five to fifty pouches are bundled as one batch) into a carton in an upright state.

A problem in automating the packing of this vertical loading is that, in a process for inserting the pouch bundle into the carton, a preceding batch already inserted into the carton and the present batch cause interference. In particular, a standing pouch such as a pouch with a spout section has a bottom material. A bottom section of the pouch is approximately twice as thick as the other portion. Therefore, after the insertion into the carton, a phenomenon tends to occur in which, because of a shift due to swelling of the pouch bundle, alignment is disordered and the pouch bundle cannot be stored in a desired position in the carton, the pouch bundle conveyed in the next batch hits the pouch bundle of the preceding batch, and the pouch bundles are not neatly inserted into the carton. Because of such a reason, conventionally, the automatic packing of the standing pouch form is difficult and manual boxing has been performed.

Under such circumstances, Patent Document 1 has been proposed that has a purpose of providing a pouch automatic packing method for bundling, in particular, pouch having different vertical thicknesses, loading the pouches in a container in an aligned state automatically and not to cause load shifting even after storage, and automatically packing the pouches, an apparatus for the pouch automatic packing method, and a robot hand apparatus of a robot used in the asparagus. The pouch automatic packing method of the invention includes a step of binding a plurality of stacked pouches, a step of loading two bundles of the bound pouches bundles one on top of the other with directions thereof changed from each other on a tray conveyed by a tray conveying apparatus, a step of placing a pad on the upper surface of the pouch bundles transferred onto the tray, and a container storage step of gripping, from the tray, with the robot, a pouch bundle group on which the pat is placed and sequentially loading and storing the pouch bundles in a container for pouch transportation. Two pouch bundles overlapping each other vertically reversely in the container is set as one stage. The pouch bundles are automatically stored and packed in a state in which the pouch bundles are stacked with pats interposed among stages. However, the pouch automatic packing method requires manual work for manually bundling a predetermined number of, for example, fifty pouches discharged from a pouch manufacturing machine and, after inspection, inserting the pouches into a packet of a binding apparatus in a state in which the pouches are bundled in the same direction. The pouch automatic packing method also requires work for inserting the bundled pouches into the packet and binding the bundled pouches with the binding apparatus to bind the bundled pouches as one pouch bundle.

CITATION LIST

Patent Document

Patent Document 1: Japanese Patent Application Laid-Open No. H10-16910 "Pouch Automatic Packing Method and Apparatus therefor, and Robot Hand Apparatus of Pouch Loading Robot" Laid open on Jan. 20, 1998

SUMMARY OF THE INVENTION

Problems to be Solved by the Invention

In the technique of Patent Document 1, the two pouch bundles are automatically laid one on top of the other with the directions thereof changed, the pad is placed on the pouch bundles, and the pouch bundles are gripped by the robot hand apparatus and loaded in the container. Therefore, even the packaging pouches in the standing form, which are slippery and automatic packing of which is difficult in the past, can be surely aligned and automatically packed. An effect can be attained that, compared with the past, manpower can be greatly saved and production costs can be reduced. However, as explained above, not only the manual work is partially required but also the operation for banding the pouches and binding the pouches into one pouch bundle with a binding apparatus is required.

It is an object of the present invention to solve the problems, that is, provide a rectangular article boxing method for handling bundles of rectangular articles such as packaging pouches, in particular, packing pouches in a standing form while keeping the bundles free without binding the bundles one by one, and for realizing consistently and completely automated boxing, and an apparatus for the method.

Means for Solving the Problems

A rectangular article boxing method of the present invention includes: a step of erecting upright and aligning a bundle of rectangular articles, gripping, lifting, transferring, and lowering the bundle using a multi-axis actuator and a hand, and inserting the bundle between a first guide and a second guide disposed at a predetermined interval in a carton; a step of displacing the first guide to above the upright bundle; a step of moving the inserted bundle to a position in contact with the existing bundle and holding the bundles with the second guide; a step of holding the upright bundles with the first guide in place of the second guide; and a step of displacing the second guide to a position at the predetermined interval from the first guide to receive the bundle to be conveyed next.

A rectangular article boxing apparatus of the present invention includes: an aligning device that erects upright and aligns a bundle of rectangular articles; a hand that grips the upright bundle; a multi-axis actuator that lifts the hand and transfers the hand to a carton placing position and lowers the hand; a first guide and a second guide disposed at a predetermined interval in a carton; and a mechanism for controlling drive of the first guide and the second guide such that the first guide is displaced to above the upright bundle, the second guide moves the inserted bundle to a position in contact with the existing bundle and holds the bundles, subsequently the first guide holds the upright bundles in place of the second guide, and the second guide is displaced to a position at the predetermined interval from the first guide to receive the bundle to be conveyed next.

In one form of the apparatus according to the present invention, the first guide and the second guide are formed in L shapes opposed to each other, and opposing portions of the first guide and the second guide are formed in a comb teeth shape such that the displacement of the first guide and the displacement of the second guide can cross without interfering with each other.

In one form of the apparatus according to the present invention, the apparatus includes lining carrying-in means in the vicinity of carton transferring means for carrying in an empty carton and carrying out a filled carton. The lining carrying-in means includes means for holding/releasing a lining and means for drawing up the held lining and transferring the lining into the carton, and has a function of packing the upright bundles of the rectangular articles in the carton in a plurality of layers.

Further, in one form of the apparatus according to the present invention, the apparatus includes a rotating mechanism for reversing the direction of the upright aligned bundle of the rectangular articles such that the bundle is oriented as desired.

Effects of Invention

The rectangular article boxing method of the present invention transfers the upright aligned bundle of the rectangular articles using the multi-axis actuator and the hand and causes the first guide and the second guide to function. Consequently, it is possible to keep a stable alignment property in an upright form in the carton without using manpower and without binding the conveyed bundle of the rectangular articles and perform consistently and completely automated boxing of the bundle of the rectangular articles. Therefore, it is possible to reduce product costs through manpower saving.

The rectangular article boxing apparatus of the present invention includes the aligning device, the hand, the multi-axis actuator of the hand, the first guide and the second guide, and the mechanism for controlling drive of the first guide and the second guide. Therefore, it is possible to actuate the first guide and the second guide to respectively play predetermined functions. It is possible to keep a stable alignment property in an upright form in the carton without using manpower and without binding the conveyed bundle of the rectangular articles and perform consistently and completely automated boxing of the bundle of the rectangular articles.

In one form of the apparatus according to the present invention, the first guide and the second guide are formed in the L shapes opposed to each other. The opposing portions of the first guide and the second guide are formed in the comb teeth shape. Therefore, the first guide and the second guide can be displaced and crossed without interfering with each other. With this form, it is possible to box the upright bundle of the rectangular articles while keeping a stable state in a work process.

In one form of the apparatus according to the present invention, the apparatus includes the lining carrying-in means in the vicinity of the carton transferring means for carrying in an empty carton and carrying out a filled carton. The lining carrying-in means includes the means for holding/releasing the lining and means for drawing up the held lining and transferring the lining into the carton. Therefore, it is possible to pack the upright bundles of the rectangular articles in the carton in a plurality of layers without using manpower.

Further, in one form of the apparatus according to the present invention, the apparatus includes a reversing mechanism for reversing the direction of the upright aligned bundle of the rectangular articles such that the bundle is oriented as desired. Consequently, it is possible to pack the bundle of the rectangular articles in the carton in any form.

BRIEF DESCRIPTION OF THE DRAWINGS

FIG. 6 is a diagram showing an example of a form in which the bundle of the rectangular articles is boxed according to the present invention.

FIG. 7 is a diagram showing a conventional pouch automatic packing apparatus.

REFERENCE SINGS LIST

Figure 1:
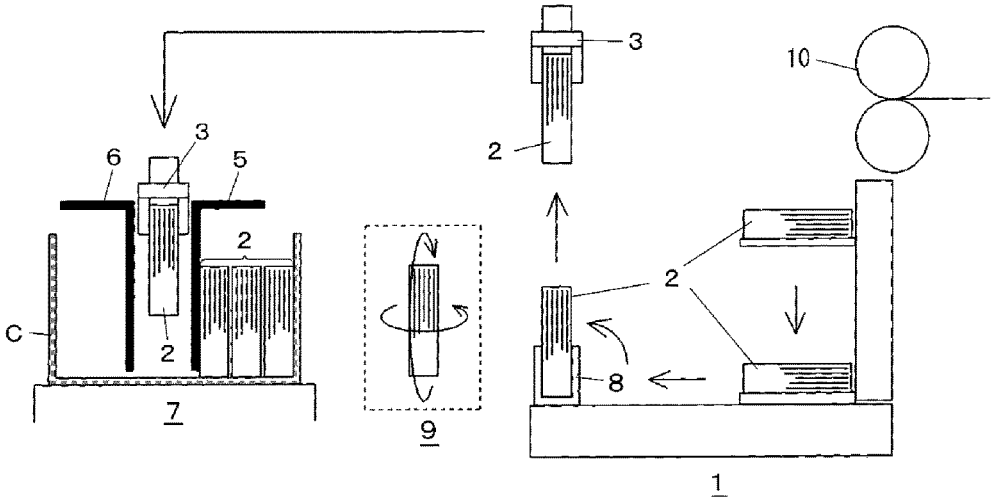
FIG. 1 is a schematic diagram for explaining a process for boxing a bundle of rectangular articles of the present invention.

1 Stacker
2 Pouch bundle
3 Hand
4 Multi-axis actuator
5 First guide
6 Second guide
7 Carton transferring means
8 Aligning device
81, 81' Rectangular frames
82, 82' Axes
83 83' Shafts
85 Lever
86, 86' Driving devices
87 Substrate
9 Rotating mechanism
10 Pouch manufacturing machine
11 Sheet carrying-in means
11*a* Vacuum pad
11*b* Up-down direction actuator
11*c* Horizontal direction actuator

MODES FOR CARRYING OUT THE INVENTION

A process for boxing a bundle of rectangular articles according to the present invention is explained with reference to FIG. 1. Packaging pouches are shown as an example of the rectangular articles. In the figure, reference numeral 10 denotes a pouch manufacturing machine of a manufacturing line and 1 denotes a stacker. A predetermined number of the packaging pouches discharged from the pouch manufacturing machine 10 are stacked by the stacker 1 as a pouch bundle 2. Subsequently, the pouch bundle 2 descends and is, after being inserted into an aligning device 8 by a not-shown pusher, rotated to be an upright and aligned state. The pouch bundle 2 in the upright and aligned state is gripped at an upper end portion by a hand 3 and conveyed to a carton C by a multi-axis actuator 4. As explained above, the operation of the multi-axis actuator 4 lifts the pouch bundle 2 from the stacker 1 first and subsequently transfers the pouch bundle 2 to an upward position of the carton C, moves the pouch bundle 2 downward into the carton C, and inserts the pouch bundle 2. Note that a broken line frame in the figure indicates a rotating mechanism 9 for changing the direction of the pouch bundle 2 such that the pouch bundle 2 is oriented as desired, when boxing the pouch bundle 2. This mechanism is adopted according to necessity.

Figure 2:
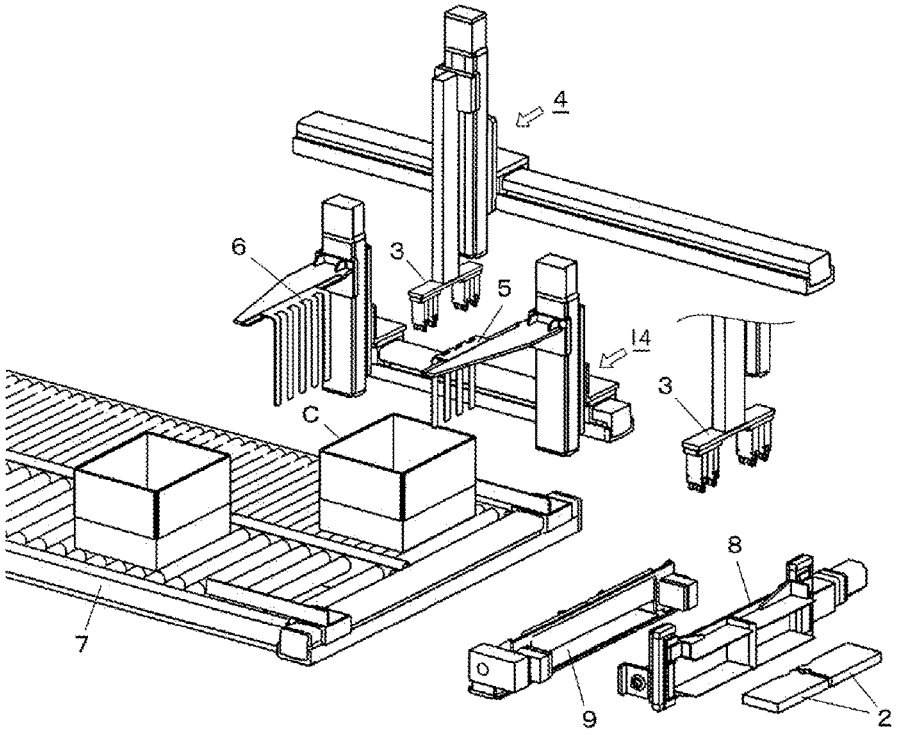
FIG. 2 is a diagram showing an embodiment of the present invention in which the bundle of the rectangular articles is boxed.

FIG. 2 is a diagram showing a first embodiment of an apparatus of the present invention that boxes a bundle of rectangular articles. The rectangular articles handled in this embodiment are packaging pouches of a standing form (a standing pouch). The pouches are manufactured and conveyed by pouch manufacturing machines in two lines. Reference numeral 8 denotes an aligning device that turns the inserted pouch bundle 2 and erects upright and aligns the pouch bundle 2. An upper panel of upper and lower panels configuring the aligning device 8 is lowered by an air cylinder or the like to compress the pouch bundle 2 and turned by rotational driving as appropriate to erect upright and align the pouch bundle 2. Reference numeral 9 denotes a rotating mechanism for changing the direction of the pouch bundle 2 such that the pouch bundle 2 is oriented as desired. The rotating mechanism 9 is adopted according to necessity. Reference numeral 3 denotes a hand that grips the pouch bundle 2. Reference numeral 4 denotes a multi-axis actuator for carrying the hand 3 from an upward position of the aligning device 8 to the carton C. Further, reference numeral 5 denotes a first guide and reference numeral 6 denotes a second guide. In this embodiment, the first guide 5 and the second guide 6 are formed in L shapes opposed to each other. Opposing portions of the first guide 5 and the second guide 6 are formed in a comb teeth shape. A configuration is adopted in which the displacement of the first guide 5 and the displacement of the second guide 6 can cross in opposing directions without interfering with each other. Reference numeral 7 denotes carton transferring means for carrying in an empty carton C and carrying out a filled carton C.

The hand 3 staying on standby above the pouch bundle 2 in the upright and aligned state in the aligning device 8 is lowered by the multi-axis actuator 4, grips the pouch bundle 2, and is driven to ascend again, and subsequently horizontally moves to an upward position where the carton C is placed. Subsequently, the hand 3 is driven to descend and inserts the pouch bundle 2 into the carton C. The first guide 5 and the second guide 6 include actuators 14 same as the multi-axis actuator 4 of the hand 3. Driving of the first guide 5 and the second guide 6 respectively conforming to procedures is driven by the actuators. Further, the first guide 5 and the second guide 6 are formed in L shapes opposed to each other. Opposing portions of the first guide 5 and the second guide 6 are formed in a comb teeth shape. A configuration is adopted in which the displacement of the first guide 5 and the displacement of the second guide 6 can cross in opposing directions without interfering with each other in a form in which the teeth of one of the first guide 5 and the second guide 6 mesh with the teeth of the other.

Figure 3:
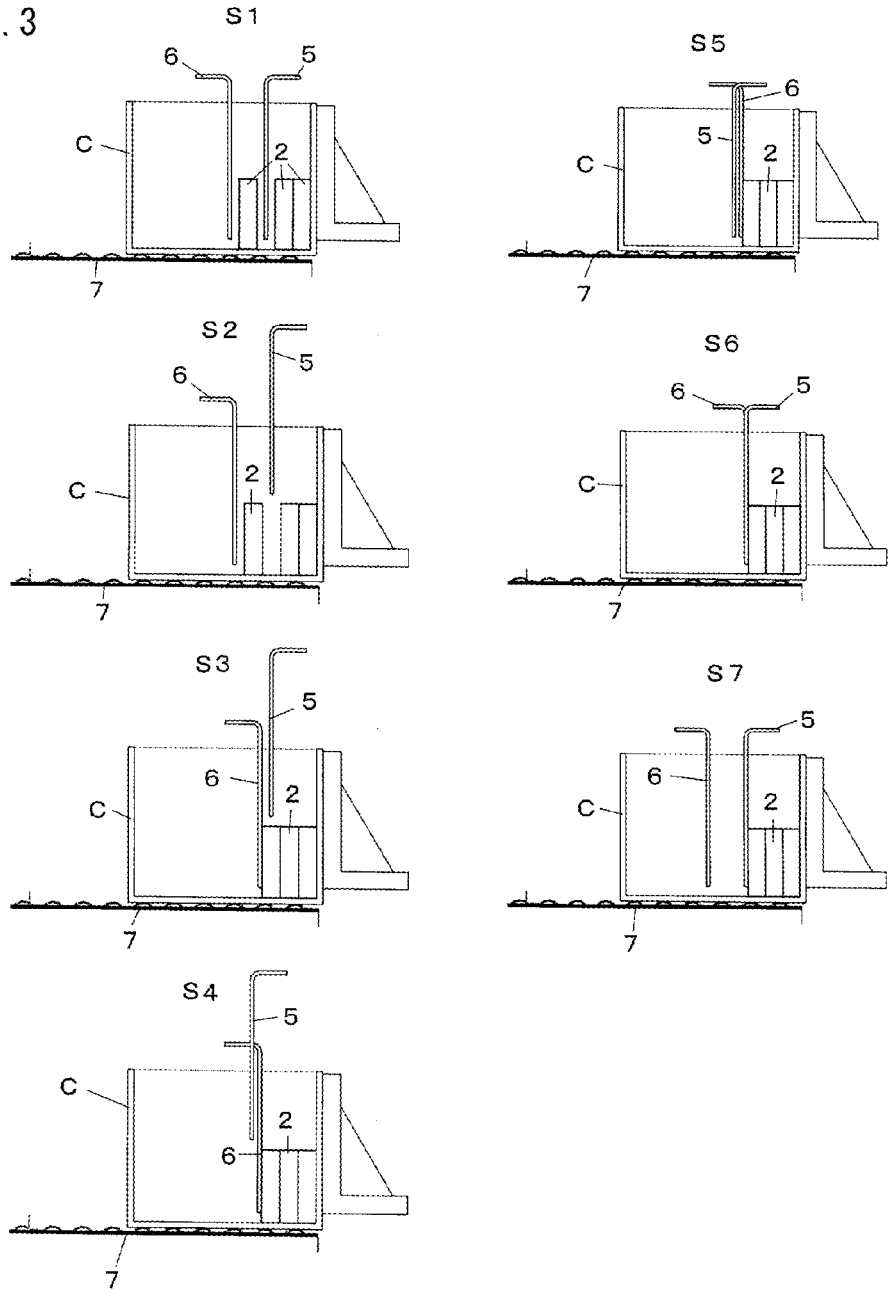
FIG. 3 is a diagram for explaining a procedure of the present invention for boxing the bundle of the rectangular articles in a carton.

A boxing operation performed by this embodiment is explained with reference to FIG. 3. In the figure, reference numeral 5 denotes a first guide, 6 denotes a second guide, and 7 denotes a conveyor that conveys the carton C. First, step 1 (S1) in the figure indicates a state in which a new pouch bundle 2 is inserted into a gap between the first guide 5 and the second guide 6. At this point, in the carton C, a group of the pouch bundles 2 inserted before is erected upright and placed close to the sidewall of the carton C. The first guide 5 plays a function of supporting the group of the pouch bundles 2 not to topple. The pouch bundle 2 inserted anew is separated from the group of the pouch bundles 2 inserted before by the presence of the first guide 5. The pouch bundles 2 do not come into contact with each other. The new bundles 2 are inserted into the carton C from the gap between the first guide 5 and the second guide 6 in a stable state.

Step 2 (S2) in the figure indicates a step in which the first guide 5 is displaced to above the upright pouch bundle 2. As shown in the figure, at this point, the pouch bundle 2 inserted anew is spaced apart from the group of the pouch bundles 2 inserted before without coming into contact the group of the pouch bundles 2. The second guide 6 is present on the opposite side of the first guide 5 via the pouch bundle 2 inserted anew. Therefore, the pouch bundle 2 inserted anew does not topple to the opposite side, although tilting to the side of the group of the pouch bundles 2 inserted before.

Step 3 (S3) in the figure indicates a step in which the second guide 6 is shifted to the right to move the pouch bundle 2 inserted anew to a position in contact with the existing group of the pouch bundles 2 and the upright state of the pouch bundle 2 inserted anew and the group of the pouch bundles 2 inserted before are retained.

Step 4 (S4) in the figure indicates a step in which the first guide 5 is moved to the left exceeding the position of the second guide 6 while retaining the upright state of the group of the pouch bundles 2 by the second guide 6.

Subsequently, step 5 (S5) in the figure indicates a step in which the first guide 5 is moved down.

Step 6 (S6) in the figure indicates a step in which, in place of the second guide 6, the first guide 5 holds the group of the pouch bundles 2 is in the upright state.

Finally, step 7 (S7) in the figure indicates a step in which the second guide 6 is displaced away from the group of the pouch bundles 2 and, to receive the next new pouch bundle 2, the second guide 6 is displaced to a position where an interval between the second guide 6 and the first guide 5 is a predetermined interval. The operation enters a cycle to new next step 1. This operation is sequentially repeated until a predetermined amount of the pouch bundles 2 are packed in the carton C. Automatic packing of the pouch bundles 2 is stably performed.

In the figure, the pouch bundles 2 are provided in one stage. However, the same operation can cope with a plurality of stages of the pouch bundles 2. Further, it is possible to cope with various packing styles by disposing an additional unit and controlling the direction and the like of pouch bundles.

Figure 4:
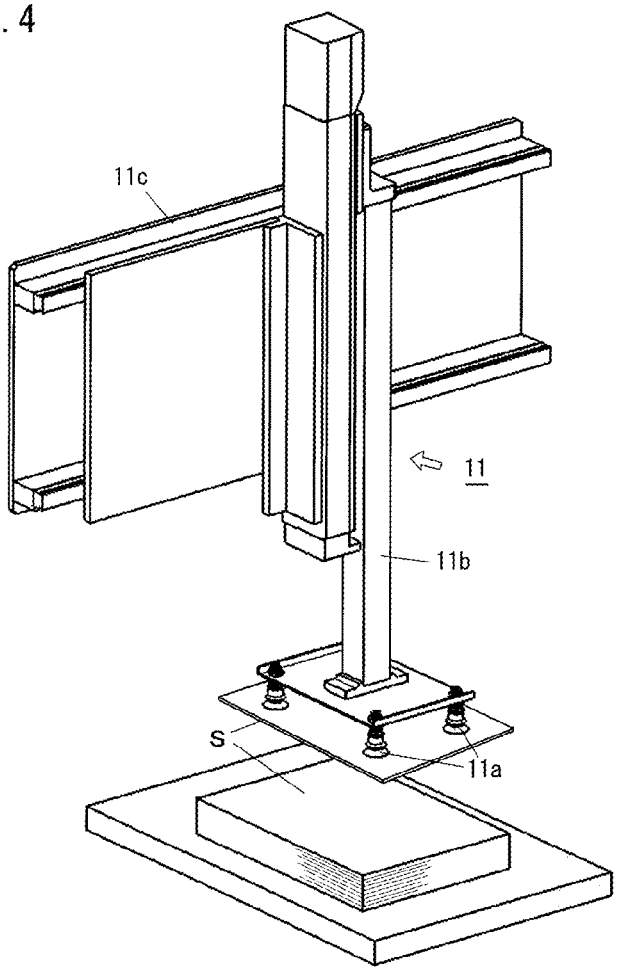
FIG. 4 is a diagram showing lining sheet carrying-in means used in an apparatus of the invention.

An embodiment in which the pouch bundles 2 are boxed in the carton C in a plurality of stages is explained. In this case, lining-sheet carrying-in means 11 shown in FIG. 4 is set in the vicinity of carton transferring means 7. Lining sheets S are inserted among the packed plurality of stages of the pouch bundles 2 to divide the pouch bundles 2. The lining-sheet carrying-in means 11 is means for placing, every time a stage of the pouch bundle 2 is formed in the carton C, placing the lining sheet S on the stage of the pouch bundle 2. The lining-sheet carrying-in means 11 is configured from vacuum pads 11*a* that grip the lining sheet S, an up-down direction actuator 11*b* that transfers the vacuum pads 11*a* from a stock position of the lining sheet S into the carton C, and a horizontal direction actuator 11C.

Note that, as the vacuum pads 11*a*, bellows are adopted to surely attract the lining sheet S. Although not shown in the figure, to prevent the vacuum pads 11*a* from attracting a plurality of lining sheets S, it is desirable to independently provide or annex means in which an air blow is disposed on a side to blow the air and form an air layer or means for applying vibration when the lining sheet S is lifted.

Figure 5:
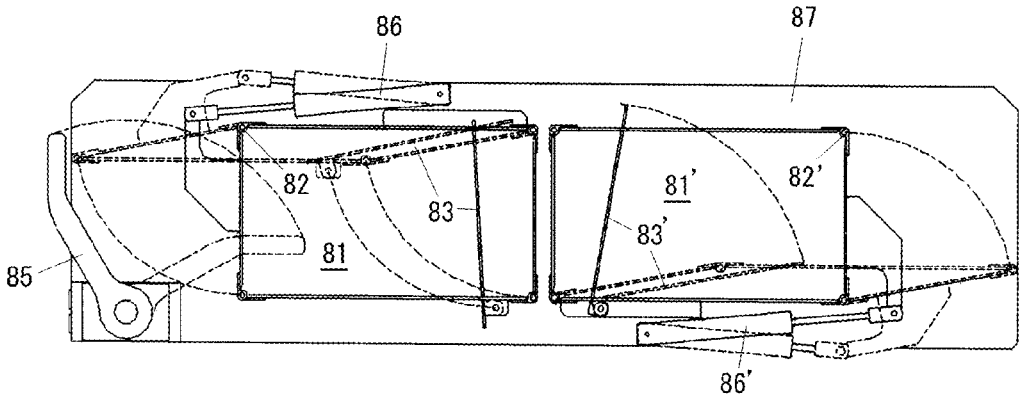
FIG. 5 is a diagram showing another embodiment of an aligning device in the apparatus of the present invention.

FIG. 5 is a diagram showing another embodiment of the aligning device 8 in the present invention.

A rectangular article such as a standing pouch form filled with a liquid cleaning agent or the like and having a spout section is a product in which, in order to improve spout performance of contents, bulging combined with ridge and trough formation is applied to the spout section to swell the spout section. When such packaging pouches with spout sections are simply bundled and boxed, there is a problem in that the spout sections are crushed. The aligning device 8 in this embodiment is means for solving the problem. The aligning device 8 sequentially shifts and aligns swelling spout portions of a plurality of pouches with spout sections of a pouch bundle.

In the aligning device 8, a substrate 87 is provided and two rectangular frames 81, 81' are annexed on the substrate 87 as a pair on the left and right. The substrate 87 is set in a vertical state. The upper long side of the left rectangular frame 81 is fixed to the substrate 87. The lower long side of the right rectangular frame 81' is fixed to the substrate 87. Reference numeral 85 denotes a lever and 86, 86' denote driving devices. The left rectangular frame 81 is pushed up and driven to be deformed into a parallelogram by the driving device 86 as indicated by a broken line. On the other hand, the right rectangular frame 81' is pushed down and driven to be deformed into a parallelogram by the driving device 86' as indicated by a broken line. As it is seen from the positions of the shafts 83, 83', the pouch with the spout section loaded in the left rectangular frame 81 and the pouch with the spout section carried into the right rectangular frame 81' are symmetrically disposed following a manufacturing line such that the spout section of the former is located on the right side and the spout section of the latter is located on the left side. Further, both of the bundles of the pouches with the spout sections loaded in the left and right rectangular frames 81, 81' are loaded on lower fixed sides by the gravity, thereafter turn the substrate 87 to a boxing process side of the next process, turn the annexed rectangular frames 81, 81' to be directed upward, and thereafter perform the deformation driving into the parallelogram. In this case, when the bundle of the pouches with the spout sections in the left rectangular frame 81 is driven to be deformed into the parallelogram by the driving device 86, the bundle of the pouches with the spout sections is pressed against the right side as indicated by a broken line. Therefore, a displacement amount of the bundle of the pouches with the spout sections in the rectangular frame 81 is large. Disorder of alignment tends to occur in the width direction of the pouches with the spout sections in a moving process of the pressing. In order to prevent the disorder of the alignment, the lever 85 is attached the left rectangular frame 81. In the deformation driving into the parallelogram of the rectangular frame 81, the lever 85 presses the bundle of the pouches with the spout sections in the rectangular frame 81 from the left side. The lever 85 turns from a base point position indicated by a solid line to a position indicated by a broken line in the figure. The lever 85 is present in the base point position when the bundle of the pouches with the spout sections is loaded in the rectangular frame 81. Before the deformation driving into the parallelogram of the rectangular frame 81 is started, when an opening on the left short side of the rectangular frame 81 turns to the broken line position and the deformation driving into the parallelogram is started, the lever 85 turns following the deformation of the rectangular fame 81 into the parallelogram. When the deformation into the parallelogram ends, the lever 85 returns to the base point position.

In this way, when the rectangular article is the pouch with the spout section of the standing form, the swelling spout portions are sequentially shifted to align the bundle of the pouches.

Further, A of FIG. 6 shows an example in which the pouch bundles 2 are simply laid one on top of the other in two stages and packed in two rows and two stages according to an embodiment of the present invention. B of FIG. 6 shows an example in which the ouch bundles 2 are laid one on top of the other in one row and two stages in alternating directions and packed in a form in which the pouch bundles 2 are aligned in an oblique row according to another embodiment.

The invention claimed is:

1. A rectangular article boxing method comprising:

a step of erecting upright and aligning a first bundle of rectangular articles, gripping, lifting, transferring, and lowering the first bundle using a multi-axis actuator and a hand, and inserting the first bundle between a first guide and a second guide disposed at a predetermined interval in a carton;

moving the first guide in an upward vertical direction to above the upright first bundle;

moving a second guide in a horizontal direction to move the inserted upright first bundle to a position in contact with an existing second bundle, and to hold the first bundle and the second bundle with the second guide;

moving the first guide horizontally across the second guide, and then moving the first guide in a downward vertical direction, so as to hold the upright first bundle and second bundle with the first guide in place of the second guide; and moving the second guide in the horizontal direction to a position at the predetermined interval from the first guide to receive a third bundle to be conveyed next, wherein the first guide and the second guide are configured to move in only the vertical direction and the horizontal direction.

2. A rectangular article boxing apparatus comprising:

an aligning device configured to erect upright and align a first bundle of rectangular articles;

a hand configured to grip the upright first bundle;

a multi-axis actuator configured to lift the hand and transfer the hand to a carton placing position and lower the hand;

a first guide and a second guide disposed at a predetermined interval in a carton; and wherein the first guide and the second guide are configured to move in only a vertical direction and a horizontal direction, such that (i) the first guide is moved in an upward vertical direction to above the upright first bundle, (ii) the second guide is moved in the horizontal direction to move the inserted upright first bundle to a position in contact with an existing second bundle, and to hold the first bundle and the second bundle, and (iii) the first guide is moved horizontally across the second guide, and then moved in a downward vertical direction so as to hold the upright first bundle and second bundle with the first guide in place of the second guide, and (iv) the second guide is moved in the horizontal direction to a position at the predetermined interval from the first guide to receive a third bundle to be conveyed next.

3. The rectangular article boxing apparatus according to claim 2, wherein the first guide and the second guide are formed in L shapes opposed to each other, and opposing portions of the first guide and the second guide are formed in a comb teeth shape such that the displacement of the first guide and the displacement of the second guide can cross without interfering with each other.

4. The rectangular article boxing apparatus according to claim 2, further comprising a carton transferring means for carrying in an empty carton and carrying out a filled carton, and a lining carrying-in means for placing a lining sheet on bundles in the carton, wherein the lining carrying-in means is disposed in a vicinity of the carton transferring means, and wherein the lining carrying-in means includes a means for holding and releasing a lining and a means for drawing up a held lining, transferring the held lining into the carton, and releasing the held lining, has a function of packing so that the rectangular article boxing apparatus is configured to pack the upright bundles of the rectangular articles in the carton in a plurality of layers.

5. The rectangular article boxing apparatus according to claim 3, further comprising a carton transferring means for carrying in an empty carton and carrying out a filled carton, and a lining carrying-in means for placing a lining sheet on bundles in the carton, wherein the lining carrying-in means is disposed in a vicinity of the carton transferring means, and wherein the lining carrying-in means includes a means for holding and releasing a lining and a means for drawing up a held lining, transferring the held lining into the carton, and releasing the held lining, and has a function of packing so that the rectangular article box apparatus is configured to pack the upright bundles of the rectangular articles in the carton in a plurality of layers.

6. The rectangular article boxing apparatus according to claim 2, further comprising a rotating mechanism for reversing a direction of the upright aligned bundle of the rectangular articles such that the bundle is oriented as desired.

7. The rectangular article boxing apparatus according to claim 3, further comprising a rotating mechanism for reversing a direction of the upright aligned bundle of the rectangular articles such that the bundle is oriented as desired.

8. The rectangular article boxing apparatus according to claim 4, further comprising a rotating mechanism for reversing a direction of the upright aligned bundle of the rectangular articles such that the bundle is oriented as desired.

9. The rectangular article boxing method according to claim 1, wherein movements of the first guide and the second guide are controlled so that the first guide and the second guide are constantly parallel to each other.

10. The rectangular article boxing apparatus according to claim 2, wherein movements of the first guide and the second guide are controlled so that the first guide and the second guide are constantly parallel to each other.

* * * * *